US008727126B2

(12) United States Patent
Monti

(10) Patent No.: US 8,727,126 B2
(45) Date of Patent: May 20, 2014

(54) CARDBOARD CONTAINER FOR RECEIVING BOTTLES IN A HORIZONTAL CONFIGURATION AND A BLANK FOR OBTAINING THE CONTAINER

(71) Applicant: Marchesini Group S.p.A., Pianoro (IT)

(72) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 0 days.

(21) Appl. No.: 13/723,441

(22) Filed: Dec. 21, 2012

(65) Prior Publication Data

US 2013/0168277 A1 Jul. 4, 2013

(30) Foreign Application Priority Data

Dec. 29, 2011 (IT) ..... BO2011A0767

(51) Int. Cl.
*B65D 5/50* (2006.01)
*B65D 81/05* (2006.01)
*B65D 5/49* (2006.01)

(52) U.S. Cl.
CPC ..... *B65D 5/5021* (2013.01); *B65D 5/504* (2013.01); *B65D 5/48042* (2013.01)
USPC ..... 206/764; 206/485; 206/526; 206/765; 206/766

(58) Field of Classification Search
CPC ... B65D 5/504; B65D 5/5021; B65D 5/48042
USPC ..... 206/182–187, 193, 477, 485, 486, 526, 206/528, 538, 756, 762, 764–766, 823
See application file for complete search history.

(56) References Cited

U.S. PATENT DOCUMENTS

| | | | | |
|---|---|---|---|---|
| 2,426,899 | A * | 9/1947 | Pantalone | 206/485 |
| 3,960,268 | A * | 6/1976 | Davis et al. | 206/485 |
| 4,485,922 | A * | 12/1984 | Desmond et al. | 206/485 |
| 5,361,907 | A * | 11/1994 | Mohrhauser | 206/528 |
| 5,505,309 | A * | 4/1996 | Taravella et al. | 206/485 |
| 5,979,662 | A * | 11/1999 | Green | 206/764 |
| 2007/0256952 | A1 * | 11/2007 | Kim-Gifford et al. | 206/485 |
| 2008/0314794 | A1 * | 12/2008 | Bowman | 206/756 |

* cited by examiner

*Primary Examiner* — Luan K Bui
(74) *Attorney, Agent, or Firm* — William J. Sapone; Ware Fressola; Maguire & Barber LLP

(57) ABSTRACT

A cardboard container has a base wall, two foldable lateral walls at two longitudinal sides thereof. The container has a pair of tabs each exhibiting a central portion connected to the base wall. A first lateral portion in a single body with the central portion is foldable with respect to the central portion and to the first lateral wall, while a second lateral portion is connected to the second lateral wall and foldable with respect to the central portion and to the second lateral wall. Each tab is foldable into a flat configuration, such that the central portion assumes an angled configuration. The tab central portions are connected to the base wall and when folded by an angle with respect thereto, they are distanced apart by a distance corresponding to the transversal dimensions of a bottle and define there-between a housing for receiving the bottle in a horizontal configuration.

14 Claims, 3 Drawing Sheets

FIG. 1
PRIOR ART
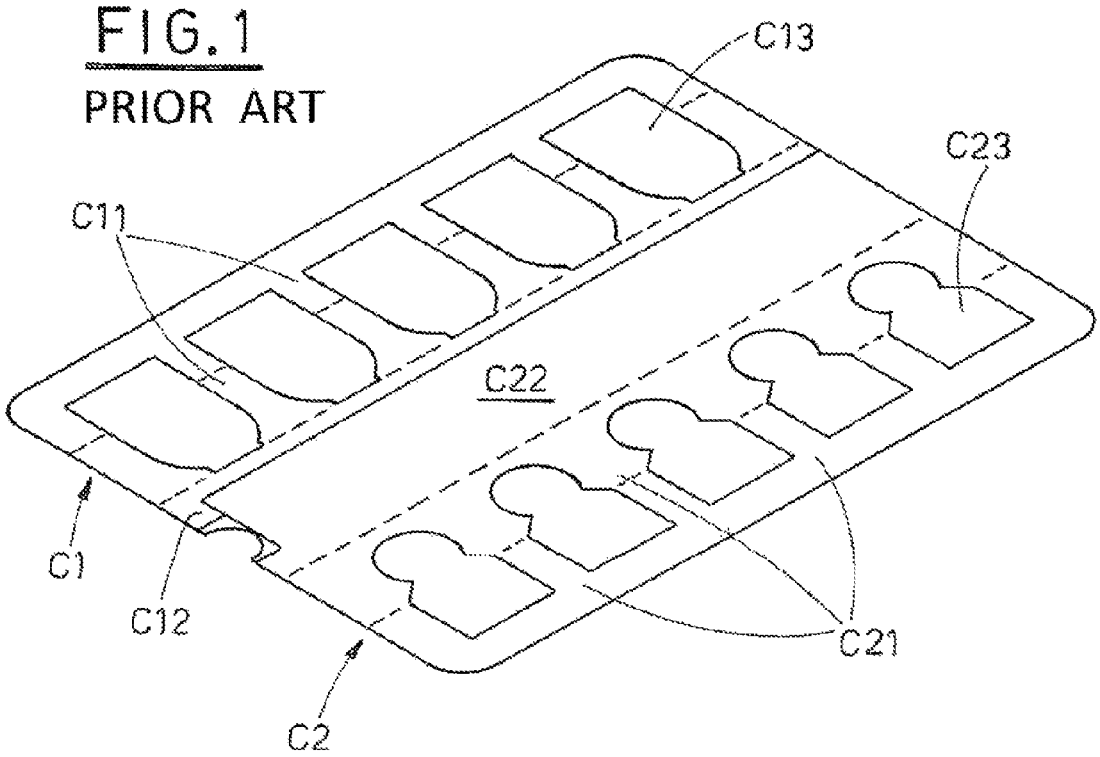
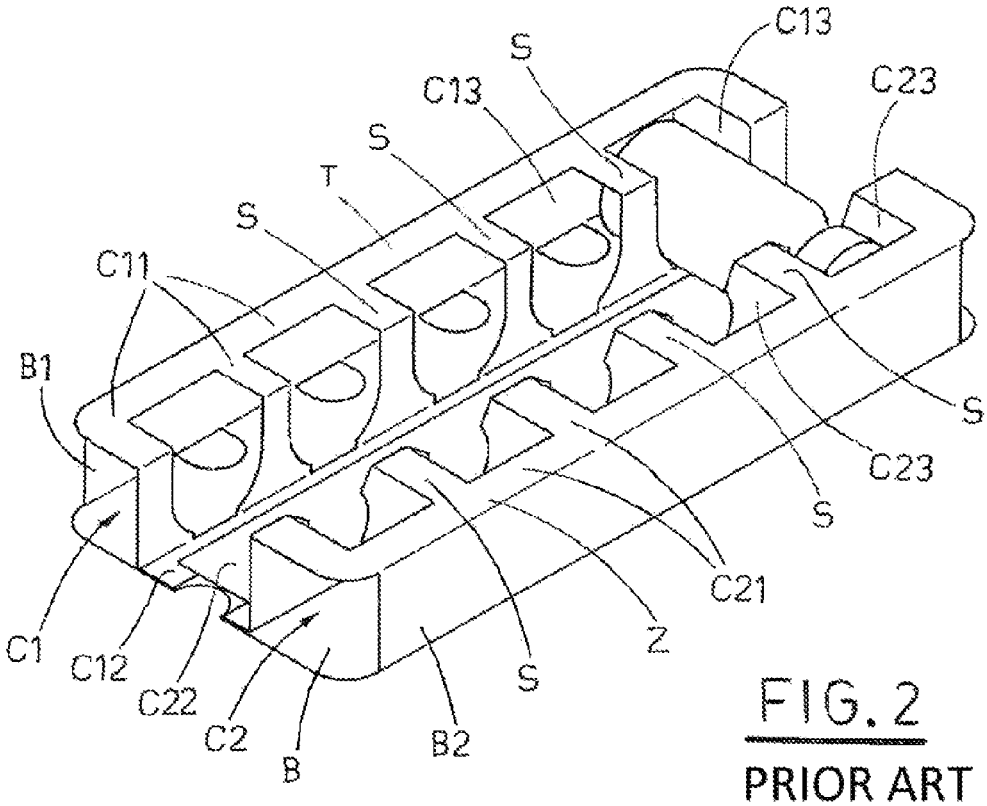
FIG. 2
PRIOR ART

CARDBOARD CONTAINER FOR RECEIVING BOTTLES IN A HORIZONTAL CONFIGURATION AND A BLANK FOR OBTAINING THE CONTAINER

FIELD OF THE INVENTION

The present invention relates to the technical sector concerning the packing of bottles, for example bottles containing pharmaceutical or cosmetic products.

DESCRIPTION OF THE PRIOR ART

In the specific technical sector, a procedure usually carried out for performing the packing of the bottles includes positioning the bottles in a relative support container with the bottles inside a relative case in order to obtain the final pack.

A first packing method includes predisposing the bottles inside the support containers in such a way that the bottles are inserted and positioned in a vertical configuration, i.e. with the mouth upwards, while a second packing method includes predisposing the bottles in the support container such that the bottles are arranged in a horizontal configuration.

Consequently, according to the different packing methods, support containers have to be used of different types, shape and structure.

The present invention relates specifically to a cardboard container for receiving the bottles in a horizontal configuration, and also a blank for obtaining the container.

The containers used for receiving the bottles in a horizontal configuration must include a sort of series of housings which enable positioning the bottles therein orientated in a horizontal configuration.

Further, the containers are generally made of cardboard and/or card starting from a relative blank, obtained from a single cardboard sheet and/or a card sheet following relative cutting operations.

The cardboard containers obtained starting from a relative blank exhibit the advantage of being conceivable so as to be able to assume a flattened configuration, which enables easy storage in relative stores, and then of being brought in to an opened-out volume, following relative folding of parts thereof with respect to others, ready to receive the bottles.

A cardboard container at present used for receiving bottles in a horizontal configuration and thus for the successive packing in relative cases, is illustrated in FIGS. 1, 2.

This prior-art container comprises a base wall (B) and two lateral walls (B1, B2) which are in a single body with the base wall (B) with a relative longitudinal side respectively at two opposite longitudinal sides of the base wall (B) and which are foldable with respect to the base wall (B) such as to be arrangeable laterally and on a same side as the base wall (B), so as to enable the container to take on a flattened configuration (FIG. 1), and to be arrangeable, following folding thereof with respect to the bottom longitudinal sides (B) at a 90° angle with respect thereto, in order for the container to assume an opened-out configuration (FIG. 2).

The container further comprises a first fold (C1) which includes a first portion (C11) which is in a single body with a first lateral wall (B1) at an opposite side to the side with which it is in a single body with the bottom (B), and a second portion (C12), which is fixed to the upper face of the bottom (B), and a second fold (C2), which comprises in turn a first portion (C21), which is in a single body with the second lateral wall (B2) at the side opposite the side with which it is in a single body with the bottom (B), and a second portion (C22) which is instead fixed above the second portion (C12) of the first fold (C1).

In particular, the first portion (C11) of the first fold (C1) is foldable so as to assume a flattened configuration, above the first lateral wall (B1) and above the bottom wall (B), when the container is in the flattened configuration (see FIG. 1), and further foldable so as to assume an angled configuration both with respect to the first lateral wall (B1) and the second portion (C12), and thus to the bottom (B), when the container is brought into the opened-out configuration, following the folding of the two lateral walls (B1, B2), with respect to the bottom (B) (see FIG. 2).

Correspondingly, the first portion (C21) too of the second fold (C2) is foldable so as to assume a flattened configuration, above the second lateral wall (B2) and above a part of the bottom (B), when the container is in the flattened configuration (see FIG. 1), and further foldable in such a way as to be able to assume an angled configuration, both with respect to the second lateral wall (B2) and the second portion (C22), and thus the bottom (B), when the container is brought into the opened-out configuration, following the folding of the two lateral walls (B1, B2) with respect to the bottom (B) (see FIG. 2).

The first portion (C11) of the first flap (C1) is provided with a series of slots (C13) while the first portion (C21) of the second flap (C2), in the same way, is provided with a relative series of slots (23).

The number of slots (C13) in the first portion (C11) of the first flap (C1) is equal to the number of slots (C23) in the first portion (C21) of the second flap (C2).

Further, the slots (13) in the first flap (C1) and the slots (23) of the second flap (C2) are realized in such positions and such a way as to be facing one another when the first portion (C11) of the first flap (C1) and the first portion C21) of the second flap (C2) are folded at an angle with respect to the bottom (B) and with respect to the two relative lateral walls (B1, B2), i.e. when the container is brought into the opened-out configuration.

In this way, a slot (C13), present in the first portion (C11) folded at an angle of the first flap (C1), with a corresponding facing slot (C23), present in the second portion (C12) folded at an angle of the second flap (C2), identify the end parts of a housing suitable for receiving a corresponding bottle in a horizontal configuration.

In this regard, the slots (C13) and (C23) are realized, respectively, in the first portion (C11) of the first flap (C1) and in the first portion (C21) of the second flap (C2) so as to exhibit a dimension in the transversal direction that at least corresponds to the transversal dimensions of the bottle (i.e. the diameter thereof).

The bottle, therefore, once the container has been brought into the opened-out configuration, following the folding of the two lateral parts (B1, B2) with respect to the bottom (B) and thus also of the folding of the first flap (C1) and the second flap (C2), is positioned in the horizontal configuration resting on the bottom (B) and with a part thereof, for example the bottom, inserted in a slot (C13) of the first flap (C1), and with another part thereof, for example the mouth, inserted in a slot (C23) of the second flap (C2), which is facing the other slot (C13) (see in particular FIG. 2).

A container made in this way exhibits however dimensions, both in the transversal direction and the longitudinal direction, that are rather large, as once opened-out, cardboard strips (S) are present between the slots (C13) of the first portion (C11) of the first flap (C1), and between the slots (C23) of the first portion (C21) of the second flap (C2), which separate one slot from another. In the same way, a strip of cardboard (T) is also present between the slots (C13) of the first portion (C11) of the first flap (C1) and the first lateral wall (B1), and also a strip of cardboard (Z) between the slots (C23) of the first portion (C11) of the second flap (C2) and the second lateral wall (B2).

These circumstances are such that when the container has been brought into the opened-out configuration, the various housings identified between the slots of the first flap and the slots of the second slot are surrounded, and separated from one another, by the cardboard strips, which has an effect on the final dimensions of the container.

In fact, the container will exhibit a transversal dimension of a decidedly higher value with respect to the height of the bottles, due to the presence of the strips of cardboard (T, Z) between the slots and the two lateral walls.

Further, the container will exhibit a longitudinal dimension significantly larger than the sum of the transversal dimensions (diameters) of the number of bottles inserted in the various housings, due to the presence of the strips (S) of cardboard between the various slots.

Further, a container of the type above does not make the operations of insertion and positioning of the bottles easy, as the bottle handling means, present in the automatic or semi-automatic packing machines, for performing the above operations, must be movable and controllable with great precision as they must be able to handle and move the single bottles so as to contemporaneously center the bottom of the bottle with a slot (C13) present in the first flap (C1) and the mouth of the bottle with a facing slot (C23) present in the first portion (C21) of the second flap (C2).

SUMMARY OF THE INVENTION

The aim of the present invention is therefore to provide a new cardboard container for receiving bottles in a horizontal configuration, and a new blank usable for obtaining the container, following a folding thereof, able to obviate the drawbacks present in the prior art.

In particular, an aim of the present invention is to provide a new cardboard container in a horizontal configuration which can assume a flattened configuration and which, once opened-out to receive the bottles, exhibits a modest volume, i.e. exhibits dimensions in a transversal direction and a longitudinal direction which are smaller with respect to the transversal and longitudinal dimensions of prior-art cardboard containers, given a same number of bottles which it is able to house.

The above aims are entirely obtained by a cardboard container comprising a base wall and two lateral walls which are in a single body with the base wall at two longitudinal sides thereof and which are foldable with respect to the base wall about the longitudinal sides in such a way as to be arrangeable on a same plane of the base wall, flanked to and external thereof, so as to enable the container to assume a flattened configuration, and also to be arrangeable at an angle with respect to the base wall, and opposite one another to enable the container to take on an opened-out configuration. The container includes at least a pair of tabs, each tab being of such a shape as to exhibit a central portion which is connected to the base wall, and foldable with respect thereto at a fold line which is arranged transversally to the base wall. A first lateral portion, in a single body with the central portion at a first lateral edge thereof, exhibits such a shape, and is connected to the first lateral wall in such a way, as to be foldable with respect both to the central portion and to the first lateral wall. A second lateral portion, in a single body with the central portion at a second lateral edge, opposite the first lateral edge, exhibits such a shape, and is connected to the second lateral wall, so as to be foldable with respect both to the central portion and to the second lateral wall. Each tab of the pair of tabs, when the two lateral walls are folded with respect to the base wall so as to be arranged on the same plane of the base wall to enable the container to assume the flattened configuration, is foldable in such a manner to be able to assume a flat configuration with the central portion thereof, the first lateral portion thereof and the second lateral portion thereof which are arranged on a same plane above the base wall and the two lateral walls. Each tab of the pair of tabs, when the two lateral walls are folded with respect to the base wall so as to be arranged at an angle with respect thereto and opposite one another so as to enable the container to assume the opened-out configuration, is further foldable such that the central portion thereof is arranged with an angled configuration and vertically with respect to the base wall, and the first lateral portion thereof and the second lateral portion thereof are arranged at an angle with respect to the central portion, opposite one another and respectively flanked to the two lateral walls. The central portions of the pair of tabs are connected to the base wall in such a way that once folded at an angle with respect to the base wall, with the container in the opened-out configuration, the central portions are distanced from one another at a distance corresponding to the transversal dimensions of a bottle, so as to define there-between a housing for receiving the bottle in a horizontal configuration.

Other special characteristics of the cardboard container provided with the present invention are described further below.

A further aim of the invention is to provide a new blank, which enables obtaining, once folded, the above described container.

BRIEF DESCRIPTION OF THE DRAWINGS

The characteristics of the invention will emerge from the following description of a preferred but not exclusive embodiment of a cardboard container for receiving bottles in a horizontal configuration and a blank from which the container is obtained, carried out with reference to the accompanying tables of drawings, in which:

FIG. 1 and FIG. 2, mentioned above, illustrate, with respective perspective views, a cardboard container for receiving bottles in a horizontal configuration according to the prior art, as described above, respectively in the flattened configuration and the opened-out configuration;

DESCRIPTION OF PREFERRED EMBODIMENTS

With reference to the accompanying figures of the drawings, (100) denotes the cardboard container for housing bottles in a horizontal configuration, and (F) denotes the blanks, usable for obtaining, following a relative folding, the container (100), disclosed by the present invention.

The cardboard container for receiving bottles (8) in a horizontal configuration comprises a base wall (10) and two lateral walls (11, 12) which are in a single body with the base wall (10) at two longitudinal sides thereof and which are foldable with respect to the base wall (10) about the longitudinal sides.

Figure 3:
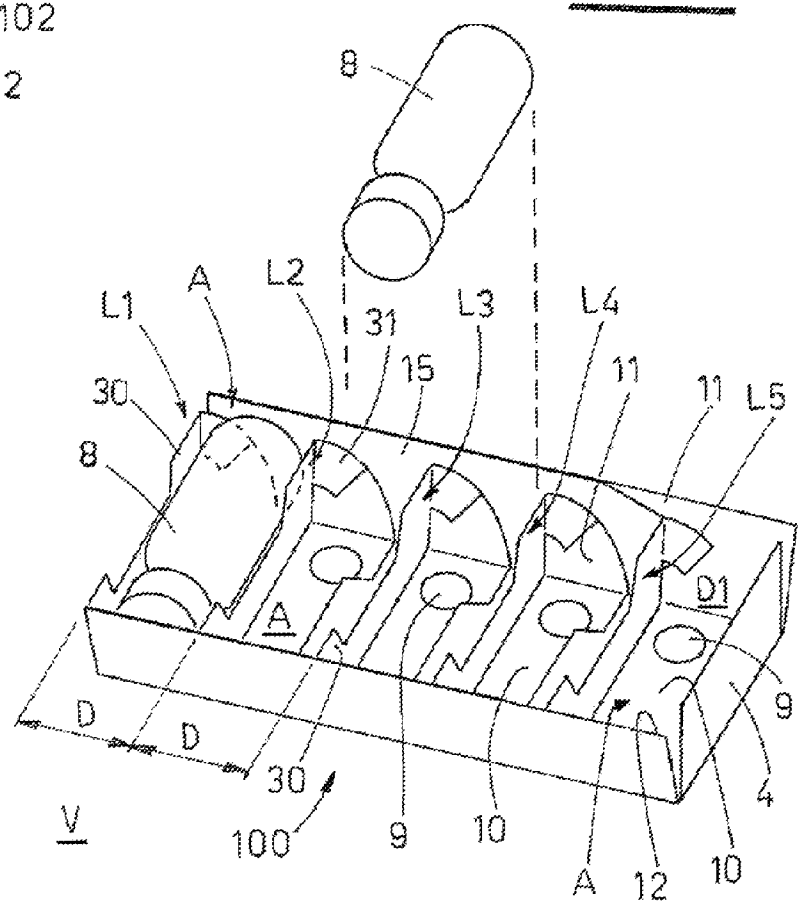
FIG. 3 illustrates, in a perspective view, the cardboard container for receiving bottles in the horizontal configuration of the present invention, in the opened out configuration ready to receive the bottles.

The two lateral walls (11, 12) are foldable with respect to the base wall (10) in such a way as to be equally arrangeable on a same plane of the base wall (10), flanked to and external thereof, so as to enable the container (100) to assume a flattened configuration (I) (see for example FIG. 4), and in such a way as to be arrangeable at an angle with respect to the base wall (10), and opposite one another so as to be able to enable the container (100) to take on an opened-out configuration (V) (see for example FIG. 3).

The container (100) comprises at least a pair of tabs (L1.L2), each tab (L1, L2) of the pair of tabs (L1, L2) being of such a shape as to exhibit:

a central portion (30) which is connected to the base wall (10), so as to be foldable with respect thereto at a fold line which is arranged transversally to the base wall (10), a first lateral portion (31), in a single body with the central portion (30) at a first lateral edge thereof and which exhibits such a shape and which is connected to the first lateral wall (11) in such a way as to be foldable with respect both to the central portion (30) and to the first lateral wall (11), and a second lateral portion (32), in a single body with the central portion (30) at a second lateral edge, opposite the first lateral edge, and which exhibits such a shape and which is connected to the second lateral wall (12) such as to be foldable with respect both to the central portion (30) and to the second lateral wall (12).

A further peculiarity of the container (100) of the present invention consists in the fact that:

each tab (L1, L2) of the pair of tabs (L1, L2), when the two lateral walls (11, 12) are folded with respect to the base wall (10) so as to be arranged on the same plane of the base wall (10) in order to enable the container (100) to assume the flattened configuration (I), is foldable in such a manner to be able to assume a flat configuration with the central portion (30) thereof, the first lateral portion (31) thereof and the second lateral portion (32) thereof which are arranged on a same plane above the base wall (10) and the two lateral walls (11, 12) (see FIG. 4), and that each tab (L1.L2) of the pair of tabs (L1, L2), when the two lateral walls (11, 12) are folded with respect to the base wall (10) so as to be arranged at an angle with respect thereto and opposite one another so as to enable the container (100) to assume the opened-out configuration (V), is further foldable such that the central portion (30) thereof is arranged with an angled configuration and vertically with respect to the base wall (10) and the first lateral portion (31) thereof and the second lateral portion (32) thereof are arranged at an angle with respect to the central portion (30), opposite one another and respectively flanked to the two lateral walls (11, 12) (see FIG. 3). Lastly, the container (100) exhibits the further peculiarity that the central portions (30) of the pair of tabs (L1, L2) are connected to the base wall (10) in such a way that once folded at an angle with respect to the base wall (10), with the container (100) in the opened-out configuration (V), the central portions (30) are distanced from one another at a distance (D) corresponding to the transversal dimensions of a bottle (8) and so as to define therebetween a housing (A) for receiving the bottle (8) in a horizontal configuration. In this way, as for example clearly illustrated in FIG. 3, the container (100) of the present invention, when brought into the opened-out configuration (V), exhibits housings (A) for receiving the bottles (8) in a horizontal configuration, which are delimited and separated from one another only by the central portions (30) of the tabs (L1, L2).

This means that a housing (A) is separated from the one contiguous thereto, only by the thickness of the central portion (30) of the tabs (L1, L2): consequently the dimensions in the longitudinal sense of the container (100) of the present invention are much smaller than those of the prior-art containers cited previously.

Further, the housings (A) are delimited in a transversal direction only by the lateral walls (11, 12), there is no presence of any strip of cardboard to separate or distance the ends of the housing (A) from the lateral walls (11, 12): consequently, also the transversal dimensions of the container (100) of the invention are smaller with respect to those of the prior-art containers cited previously, and substantially corresponding to the height of the bottles, apart from the width, of a negligible size, of the two lateral walls (11, 12).

The special conformation and structure of the container (100), in particular the shape of the housings (A) and the way in which they are defined once the container (100) is brought into the opened-out configuration (V), makes it particularly easy and simple to insert and position the bottles in a horizontal configuration by means of the handling means present in automatic and/or semi-automatic packing machines.

Other further characteristics of the container (100) disclosed in the present invention, and also illustrated in the preferred embodiment of the accompanying figures are reported and described in the following.

A first tab (L1) of the pair of tabs (L1, L2) is such that the central portion (30) thereof is in a single body with the base wall (10) at a first transversal edge (101) thereof and is foldable with respect to the first transversal edge (101) in such a way that the central portion (30) can be arranged indifferently both above the base wall (10) and with an angled configuration, vertically, for example by 90°, with respect to the base wall (10).

Figure 5:
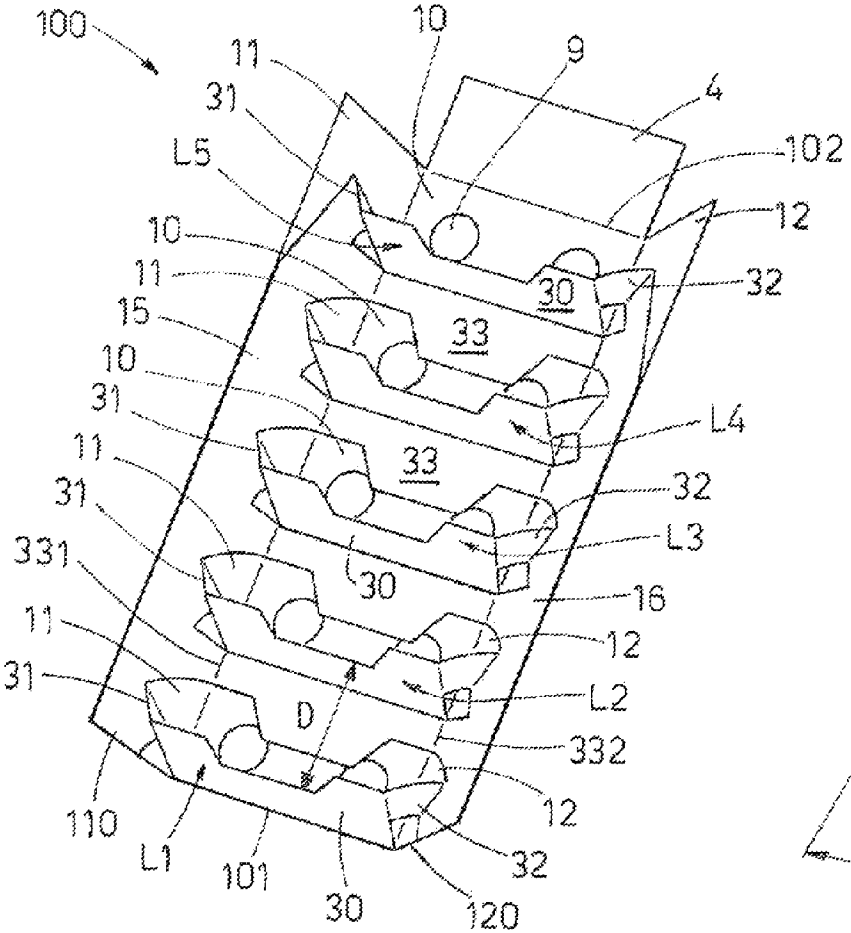
FIG. 5 illustrates, in a perspective view, the cardboard container of the invention in a passage step from the flattened configuration of FIG. 4 to the opened out volume of FIG. 3.
Figure 4:
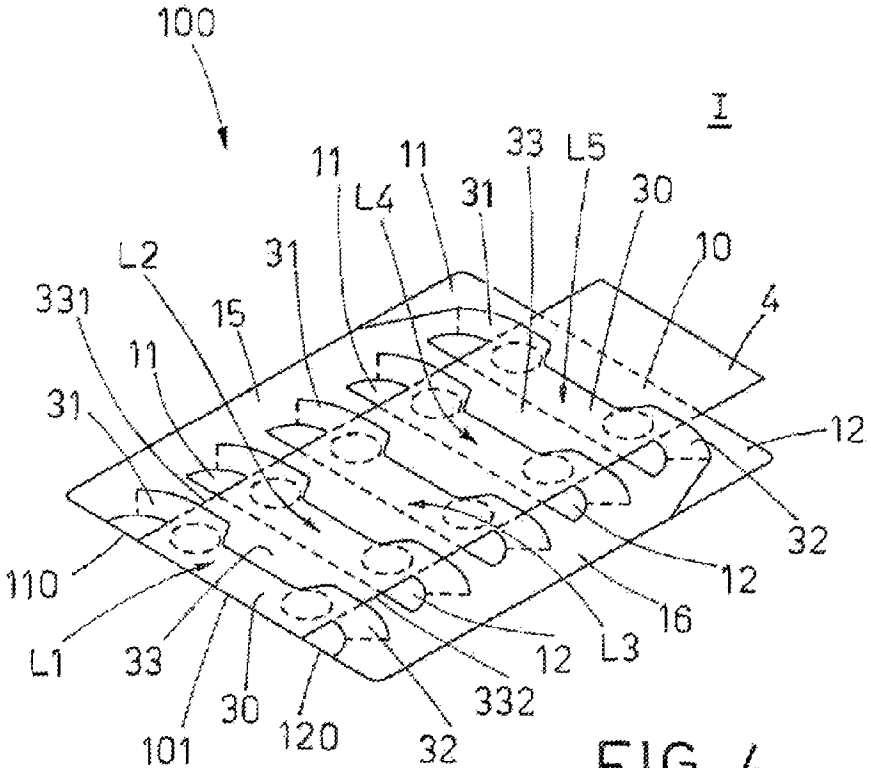
FIG. 4 illustrates, in a perspective view, the cardboard container of the invention in the flattened configuration thereof, for storing in a relative store (not illustrated) afforded in automatic or semi-automatic packing machines.

A second tab (L2) of the pair of tabs (L1, L2) is such that the central portion (30) thereof is provided with an appendage (33) by means of which appendage (33) the central portion (30) is connected to the base wall (10), with the central portion (30) of the second tab (L2) that is foldable with respect to the appendage (33) in such a way that the central portion (30) can be arranged indifferently both above the base wall (10) and with an angled configuration and vertically, for example by 90°, with respect to the base wall (10) (see in particular FIG. 5 and FIG. 4).

The container (100) further includes a first auxiliary wall (15) and a second auxiliary wall (16), clearly visible for example in FIG. 4 and FIG. 5.

The first auxiliary wall (15) is in a single body with the first lateral wall (11), at a first transversal edge (110) thereof, contiguous to the first transversal edge (101) of the base wall (10), and which exhibits a shape and which is folded with respect to the first lateral wall (11), at the first transversal edge (101), such as to be in contact with and connected with the facade thereof that is flanked to the facade of the base wall (10) to which the tabs (L1, L2) are connected.

Correspondingly, the second auxiliary wall (16) is in a single body with the second lateral wall (12) at a first transversal edge (120) thereof, contiguous to the first transversal edge (101) of the base wall (10), and which exhibits such a shape and which is folded with respect to the second lateral wall (12), at the first transversal edge (120), such as to be in contact with and connected to the facade thereof which is flanked to the facade of the base wall (10) to which the tabs (L1, L2) are connected.

In this situation, the first lateral portion (31) of the first tab (L1) and the first lateral portion (31) of the second tab (L2) are such as both to be connected in a single body with the first auxiliary wall (15) at two distinct positions such as to be foldable with respect to the first auxiliary wall (15) in order to be indifferently arranged both by a side of, on a same plane, as the first auxiliary wall (15) and above the first lateral wall (11), with the container (100) placed in the flattened configuration (I)(see FIG. 4), and folded against and on the first auxiliary wall (15) and at an angle with respect to the central portion (30), when the first lateral wall (11) is folded at an angle with respect to the base wall (10) and with the container (100) in the opened-out configuration (V) (see FIG. 5).

Correspondingly, the second lateral portion (32) of the first tab (L1) and the second lateral portion (32) of the second tab (L2) are such as to be both connected in a single body with the second auxiliary wall (16) at two distinct positions in such a way as to be foldable with respect to the second auxiliary wall (16) such as to be indifferently arranged both by a side, on a same plane, as the second auxiliary wall (16) and above the second lateral wall (12), with the container (100) in the flattened configuration (I) (see FIG. 4), and folded against and on the second auxiliary wall (16) and at an angle with respect to the central portion (30), when the second lateral wall (12) is folded at an angle with respect to the base wall (10) and with the container (100) in the opened-out configuration (V) (see FIG. 5).

Further, the appendage (33) of the central portion (30) of the second tab (L2) is such as to exhibit a first part (331) connected in a single body with a portion of the first auxiliary wall (15) and a second part (332), opposite the first part (331), connected in a single body with a portion of the second auxiliary wall (16), in such a way that the first auxiliary wall (15) and the second auxiliary wall (16) are respectively foldable with respect to the first part (331) and the second part (332) of the appendage (33) when the two lateral walls (11, 12) are folded at an angle with respect to the base wall (10) (see for example FIG. 5, which illustrates a folding step of the two lateral walls (11, 12) with respect to the base wall (10) such as to bring the container into the opened-out configuration (V) of FIG. 3).

The base wall (10), the two lateral walls (11, 12) and the first auxiliary wall (15) and the second auxiliary wall (16), as shown in the figures relating to a preferred by not exclusive embodiment of the container of the invention, exhibit dimensions that are such that the container (100) can further comprise third, fourth and fifth tabs (L3, L4, L5) having an identical shape and structure as the second tab (L2) and such that each of the further tabs (L3, L4, L5) exhibits:

a central portion (30), provided with an appendage (33) by means of which appendage (33) the central portion (30) is connected to the base wall (10) such as to be foldable with respect to the base wall (10) in order to be arranged indifferently both above it and with an angled configuration, vertically, with respect to the base wall (10);

a first lateral portion (31) which is connected in a single body with the first auxiliary wall (15) and such as to be foldable with respect to both the central portion (30) and to the first auxiliary wall (15), and thus with respect to the first lateral wall (11), and a second lateral portion (32) which is connected in a single body with the second auxiliary (16) and such as to be foldable with respect both to the central portion (30) and the second auxiliary wall (16), and thus with respect to the second lateral wall (12).

The central portions (30) of the further tabs (L3, L4, L4) are connected by means of the relative appendages (33) to the base wall (10) in positions such as to be reciprocally distanced from one another, when folded with an angled configuration with respect to the base wall (10), with a distance (D) corresponding to the transversal dimensions of a bottle (8) and such as to define between them a housing (A) for receiving the bottle (8) in a horizontal configuration and such that the central portion (30) of the second tab (L2) and the central portion (30) of the third further tab (L3) are distanced from one another, when folded with an angled configuration with respect to the base wall (10), with a distance (D) corresponding to the transversal dimensions of a bottle (8) and such as to define there-between a housing (A) for receiving the bottle (8) in a horizontal configuration.

The base wall (10) exhibits through-holes (9) situated in such a position that when the tabs (L1, L2, L3, L4, L5) are folded in such a way as to take on a flat configuration above the base wall (10), with the container (100) in the flattened configuration (I), the central portions (30) of the tabs (L1, L2, L3, L4, L5) are positioned also above the through-holes (9).

The through-holes (9) are of such dimensions as to enable passage of pusher means the use of which is for pushing the central portions (30) of the tabs (L1, L2, L3, L4, L5) to fold with respect to the base wall (10) and be arranged at an angle, and vertically with respect thereto, when the lateral walls (11, 12) are folded with respect to the base wall (10) such as to bring the container (100) into the opened-out configuration (V).

This detail makes the operations of passage of the container from the flattened configuration to the opened-out configuration easier, simpler and more rapid.

Lastly, the container (100) can comprise a wing (4) in a single body with the base wall (10) at a second transversal edge (102) thereof, opposite the first transversal edge (101), and which is foldable with respect to the base wall (10) in such a way as to be arrangeable indifferently both on the same plane as the base wall (10), when the container (100) is in the flattened configuration (I), and in an angled configuration and vertically with respect to the base wall (10), when the container (100) is brought into the opened-out configuration (V).

In particular, in this case the container (100) has a base wall (10) which exhibits dimensions that are such that with the container (100) in the opened out configuration (V), between the wing (4) folded at an angle with respect to the base wall (10) and the last tab of the tabs (L1, L2, L3, L4, L5) a space (D1) is present having dimensions that at least correspond to the transversal dimensions of a bottles (8) and such as to define there-between a housing (A) for receiving the bottle (8) in a horizontal configuration.

Figure 6:
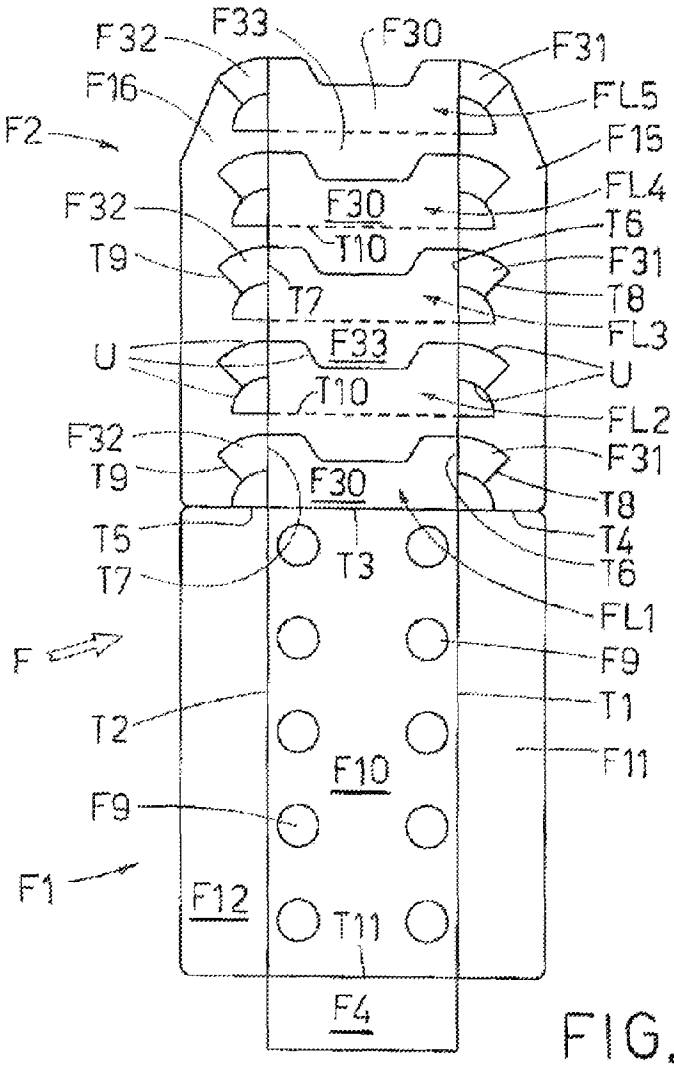
FIG. 6 is a view from above of the blank of the invention, from which, following the folding thereof, the container of FIGS. 3-5 can be obtained.

FIG. 6 illustrates the blank (F) made of card or cardboard from which following the folding the container can receive bottles in a horizontal configuration, object of the present invention.

The blank (F) is obtained starting from a single sheet of cardboard following cutting operations thereof which can be performed with cutting techniques used in the paper industry.

These cutting operations on the sheet of card or cardboard are performed in such a way that to obtain a blank (F) which comprises a main section (F1) and an auxiliary section (F2), flanked to one another and in a single body at a relative common transversal side.

The main section (F1) exhibits a central section (F10), a first lateral section (F11) and a second lateral section (F12), situated at two opposite longitudinal sides thereof.

The auxiliary section (F2), in turn, has such a shape, and is obtained such as to include a series of cut and weakened lines (U) which are realized in such a way and with an extension such that the auxiliary section (F2) exhibits a first auxiliary lateral portion (F15) and a second lateral auxiliary portion (F16) and, between the first lateral auxiliary portion (F15) and the second lateral auxiliary portion (F16) in a single body therewith, at least a pair of tabs (FL1, FL2).

Each tab (FL1, FL2) of the pair of tabs exhibits a central portion (F30), a first lateral portion (F31), connected in a single body with the first lateral auxiliary portion (F15) and a second lateral portion (F32), connected in a single body with the second auxiliary lateral portion (F16).

The blank (F) is obtained from the cardboard sheet in such a way that it comprises:

a first fold line (T1) between the central section (F10) and the first lateral section (F11) of the main section (F1), such as to enable folding the first lateral section (F11) with respect to the central section (F10) in such a way that the first lateral section (F11) can be arranged in an angled position with respect to the central section (F10), a second fold line (T2) between the central section (F10) and the second lateral section (F12) of the main section (F1), such as to enable folding the second lateral section (F12) with respect to the central section (F10) such that the second lateral section (F12) can be arranged in an angled position with respect to the central section (F10), a third fold line (T3), at a part of the common transversal side, between the central section (F10) of the main section (F1) and the central portion (F30) of a first tab (FL1), a fourth fold line (T4), at a second part of the common transversal side, between the first lateral section (F11) of the main section (F1) and the first lateral auxiliary portion (F15) of the auxiliary section (F2), and a fifth fold line (T5) at a third part of the common transversal side, between the second lateral section (F12) of the main section (F1) and the second auxiliary lateral portion (F16) of the auxiliary section (F2).

In this way, the third (T3), fourth (T4) and fifth (T5) fold lines being such that the auxiliary section (F2) is foldable above the main section (F1) in such a way that the first auxiliary lateral portion (F15) of the auxiliary section (F2) is arranged above and is fixable to the first lateral section (F11) of the main section (F1), the second auxiliary lateral portion (F16) of the auxiliary section (F2) is arranged above and is fixable to the second lateral section (F12) of the main section (F1) and such that the central portion (F30) of the second tab (FL2) of the pair of tabs (FL1, FL2) is fixable to a part of the central section (F10) in such a way that and such that the central portion (F30) is foldable with respect to the central section (F10) in order to be arranged indifferently both above and with an angled configuration with respect thereto.

Further, the third fold line (T3) also being such that the central portion (F30) of the first tab (FL1), once the auxiliary section (F2) has been folded above the main section (F1), is foldable with respect to the central section (F10) of the main section (F1) such as to be arrangeable indifferently both above and with an angled configuration with respect thereto.

In this way the blank (F) is foldable such as to enable obtaining the container (100) in the flattened configuration of FIG. 4.

Further, the blank (F) is obtained in such a way as to further comprise, for each of the tabs (FL1.FL2)) of the pairs of tabs (FL1, FL2):

fold lines (T6) between the central portion (F30) and the first lateral portion (F31), fold lines (T7) between the central portion (F30) and the second lateral portion (F32), fold lines (T8) between the first lateral portion (F31) and the first auxiliary lateral portion (F15) and fold lines (T9) between the second lateral portion (F32) and the second auxiliary lateral portion (F16).

The fold lines (T6, T7, T8.T9) being realised and arranged in such a way that the first lateral portion (F31) of each tab (FL1, FL2) is foldable with respect both to the relative central portion (F30) and with respect to the first auxiliary lateral portion (F15), and the second lateral portion (F32) of each tab (FL1, FL2) is foldable with respect both to the relative central portion (F30) and with respect to the second auxiliary lateral portion (F16), in such a way as to be arrangeable indifferently both on a same common plane of the central portion (F30) and in an angled configuration with respect thereto, when the central portion (F30) is folded with an angled configuration with respect to the central section (F10) of the main section (F1).

The blank (F) is also obtained such that the second tab (FL2) of the pair of tabs (FL1.FL2) exhibits such a shape as to exhibit an appendage (F33) by means of which appendage (F33) the second tab (FL2) is fixed to the central section (F10) of the main section (F1) when the auxiliary section (F2) is folded above the main section (F1).

In this regard, the blank (F) is provided with a fold line (T10) between the central portion (F30) and the appendage (F33) of the second tab (FL2) such as to enable the central portion (F30), once the appendage (F33) has been fixed to the central section (F10) of the main section (F1), to be foldable with respect to the appendage (F33) such as to be arrangeable with an angled configuration with respect thereto and thus with respect to the central section (F10).

Further, the blank (F) according to the number of bottles which the container will receive, can be obtained in such a way that the main section (F1) and the auxiliary section (F2) exhibit dimensions such that the auxiliary section (F2) comprises further other cut and weakened lines (U) that have been made in such a way that, and with such an extension, that the auxiliary section (F2) also exhibits further other tabs (FL3, FL4, FL5) having a shape and structure that are identical to the shape and structure of the second tab (FL2).

Each of the further tabs (FL3, FL4, FL5) exhibits a central portion (F30), a first lateral portion (F31) connected in a single body with the first auxiliary lateral portion (F15) and a second lateral portion (F32), connected in a single body with the second auxiliary lateral portion (F16).

The blank (F) consequently is obtained in such a way as to comprise further other fold lines (T6, T7, T8, T9) such as to enable the first lateral portion (F31) of each tab (FL3, FL4, FL5) to be foldable with respect both to the relative central portion (F30) and with respect to the first auxiliary lateral portion (F15), and the second lateral portion (F32) of each tab (FL3, FL4, FL5) to be foldable with respect both to the relative central portion (F30) and with respect to the second auxiliary lateral portion (F16), such as to be arrangeable indifferently both on a same common plane of the central portion (F30) and in an angled configuration with respect thereto, when the central portion (F30) is folded with an angled configuration with respect to the central portion (F10) of the main section (F1).

The blank (F) is obtained from the sheet of card and/or cardboard in such a way that the cutting and weakened lines (U) are realised in the auxiliary section (F2) in such a way and with such an extension that the central portions (F30) of the tabs (FL1, FL2, FL3, FL4, FL5) are reciprocally positioned with respect to one another in such a way that once the auxiliary section (F2) has been folded above the main section (F1) and the central portions (F30) of the tabs (FL1, FL2, FL3, FL4.FL5) have been folded at an angle with respect to the central section (F10) of the main section (F1), the central portions (F30) are distanced from one another in such a way as to define there-between a housing having suitable dimensions for receiving a corresponding bottle in a horizontal configuration.

The central section (F10) of the main section (F1) comprises a series of through-holes (F9) which have been made in such positions as to be positioned below the central portions (F30) of the tabs (FL1, FL2, FL3, FL4, FL5) when the auxiliary section (F2) is folded above the main section (F1).

The blank (F) is obtained in such a way that the central section (F10) of the main section (F1) exhibits a wing (F4), at the transversal side thereof opposite the transversal side with which it is in a single body with the auxiliary section (F2), and a fold line (T11) between the wing (F4) and the central section (F10) such as to enable the wing (F4) to be foldable with respect to the central section (F10) in such a way as to be arrangeable with an angled configuration with respect thereto.

The above has been described by way of non-limiting example, and any eventual constructional variants are understood to fall within the scope of the following claims.

The invention claimed is:

1. A cardboard container for receiving bottles (8) in a horizontal configuration, comprising:

a base wall (10) and two lateral walls (11, 12) which are in a single body with the base wall (10) at two longitudinal sides thereof and which are foldable with respect to the base wall (10) about the longitudinal sides so as to be arrangeable on a same plane of the base wall (10), flanked to and external thereof, so as to enable the container (100) to assume a flattened configuration (I), and so as to be arrangeable at an angle with respect to the base wall (10), and opposite one another such as to be able to enable the container (100) to take on an opened-out configuration (V), at least a pair of tabs (L1, L2), each tab (L1, L2) being of such a shape as to exhibit a central portion (30) which is connected to the base wall (10), so as to be foldable with respect thereto at a fold line which is arranged transversally to the base wall (10), a first lateral portion (31), in a single body with the central portion (30) at a first lateral edge thereof and which exhibits such a shape and which is connected to the first lateral wall (11) in such a way as to be foldable with respect both to the central portion (30) and to the first lateral wall (11), a second lateral portion (32), in a single body with the central portion (30) at a second lateral edge, opposite the first lateral edge, and which exhibits such a shape and which is connected to the second lateral wall (12) so as to be foldable with respect both to the central portion (30) and to the second lateral wall (12), wherein each tab (L1, L2) of the pair of tabs (L1,12), when the two lateral walls (11, 12) are folded with respect to the base wall (10) so as to be arranged on the same plane of the base wall (10) to enable the container (100) to assume the flattened configuration (I), is foldable so as to assume a flat configuration with the central portion (30) thereof, the first lateral portion (31) thereof and the second lateral portion (32) thereof which are arranged on a same plane above the base wall (10) and the two lateral walls (11, 12), and wherein each tab (L1, L2) of the pair of tabs (L1, L2), when the two lateral walls (11, 12) are folded with respect to the base wall (10) so as to be arranged at an angle with respect thereto and opposite one another so as to enable the container (100) to assume the opened-out configuration (V), is further foldable such that the central portion (30) thereof is arranged with an angled configuration and vertically with respect to the base wall (10) and the first lateral portion (31) thereof and the second lateral portion (32) thereof are arranged at an angle with respect to the central portion (30), opposite one another and respectively flanked to the two lateral walls (11, 12), and wherein the central portions (30) of the pair of tabs (L1, L2) are connected to the base wall (10) so that once folded at an angle with respect to the base wall (10), with the container (100) in the opened-out configuration (V), the central portions (30) are distanced from one another at a distance (D) corresponding to transversal dimensions of a bottle (8) and so as to define there-between a housing (A) for receiving the bottle (8) in a horizontal configuration.

2. The container of claim 1, wherein a first tab (L1) of the pair of tabs (L1, L2) is such that the central portion (30) thereof is in a single body with the base wall (10) at a first transversal edge (101) thereof and is foldable with respect to the first transversal edge (101) in such a way that the central portion (30) can be arranged indifferently both above the base wall (10) and with an angled configuration, vertically with respect to the base wall (10), and that a second tab (L2) of the pair of tabs (L1, L2) is such that the central portion (30) thereof is provided with an appendage (33) by means of which appendage (33) the central portion (30) is connected to the base wall (10), with the central portion (30) of the second tab (L2) that is foldable with respect to the appendage (33) in such a way that the central portion (30) can be arranged indifferently both above the base wall (10) and with an angled configuration, vertically with respect to the base wall (10), and further comprising a first auxiliary wall (15) and a second auxiliary wall (16), the first auxiliary wall (15) being in a single body with the first lateral wall (11), at a first transversal edge (110) thereof, contiguous to the first transversal edge (101) of the base wall (10), and which exhibits a shape and which is folded with respect to the first lateral wall (11), at the first transversal edge (101), so as to be in contact with and connected with the facade thereof that is flanked to the facade of the base wall (10) to which the tabs (L1, L2) are connected, and with the second auxiliary wall (16) that is in a single body with the second lateral wall (12) at a first transversal edge (120) thereof, contiguous to the first transversal edge (101) of the base wall (10), and which exhibits such a shape and which is folded with respect to the second lateral wall (12), at the first transversal edge (120), so as to be in contact with and connected to the facade thereof which is flanked to the facade of the base wall (10) to which the tabs (L1, L2) are connected, and wherein the first lateral portion (31) of the first tab (L1) and the first lateral portion (31) of the second tab (L2) are such as both to be connected in a single body with the first auxiliary wall (15) at two distinct positions such as to be foldable with respect to the first auxiliary wall (15) in order to be indifferently arranged both by a side of, on a same plane, as the first auxiliary wall (15) and above the first lateral wall (11), with the container (100) placed in the flattened configuration (I), and folded against and on the first auxiliary wall (15) and at an angle with respect to the central portion (30), when the first lateral wall (11)

is folded at an angle with respect to the base wall (10) and with the container (100) in the opened-out configuration (V), and that the second lateral portion (32) of the first tab (L1) and the second lateral portion (32) of the second tab (L2) are such as to be both connected in a single body with the second auxiliary wall (16) at two distinct positions so as to be foldable with respect to the second auxiliary wall (16) so as to be indifferently arranged both by a side, on a same plane, as the second auxiliary wall (16) and above the second lateral wall (12), with the container (100) in the flattened configuration (I), and folded against and on the second auxiliary wall (16) and at an angle with respect to the central portion (30), when the second lateral wall (12) is folded at an angle with respect to the base wall (10) and with the container (100) in the opened-out configuration (V).

3. The container of claim 2, wherein the appendage (33) of the central portion (30) of the second tab (L2) is such as to exhibit a first part (331) connected in a single body with a portion of the first auxiliary wall (15) and a second part (332), opposite the first part (331), connected in a single body with a portion of the second auxiliary wall (16), in such a way that the first auxiliary wall (15) and the second auxiliary wall (16) are respectively foldable with respect to the first part (331) and the second part (332) of the appendage (33) when the two lateral walls (11, 12) are folded at an angle with respect to the base wall (10).

4. The container of claim 3, wherein the base wall (10), the two lateral walls (11, 12) and the first auxiliary wall (15) and the second auxiliary wall (16) exhibit dimensions that are such that the container (100) further comprise third, fourth and fifth tabs (L3, L4, L5) having an identical shape and structure as the second tab (L2) and such that each of the further tabs (L3, L4, L5) exhibits:

a central portion (30), provided with an appendage (33) by means of which appendage (33) the central portion (30) is connected to the base wall (10) such as to be foldable with respect to the base wall (10) in order to be arranged indifferently both above it and with an angled configuration, vertically, with respect to the base wall (10);

a first lateral portion (31) which is connected in a single body with the first auxiliary wall (15) and such as to be foldable with respect to both the central portion (30) and to the first auxiliary wall (15), and thus with respect to the first lateral wall (11), and a second lateral portion (32) which is connected in a single body with the second auxiliary (16) and such as to be foldable with respect both to the central portion (30) and the second auxiliary wall (16), and thus with respect to the second lateral wall (12).

5. The container of claim 4, wherein the central portions (30) of the further tabs (L3, L4, L4) are connected by means of the relative appendages (33) to the base wall (10) in positions so as to be reciprocally distanced from one another, when folded with an angled configuration with respect to the base wall (10), with a distance (D) corresponding to the transversal dimensions of a bottle (8) and such as to define between them a housing (A) for receiving the bottle (8) in a horizontal configuration and such that the central portion (30) of the second tab (L2) and the central portion (30) of the third further tab (L3) are distanced from one another, when folded with an angled configuration with respect to the base wall (10), with a distance (D) corresponding to the transversal dimensions of a bottle (8) and such as to define there-between a housing (A) for receiving the bottle (8) in a horizontal configuration.

6. The container of claim 5, wherein the base wall (10) exhibits through-holes situated such that when the tabs (L1, L2, L3, L4, L5) are folded so as to take on a flat configuration above the base wall (10) with the container (100) in the flattened configuration (I), the central portions (30) of the tabs (L1, L2.L3, L4, L5) are positioned also above the through-holes (9), with the through-holes (9) being of such dimensions as to enable passage of pusher means for pushing the central portions (30) of the tabs (L1, L2, L3, L4, L5) to fold with respect to the base wall (10) and be arranged at an angle, and vertically with respect thereto, when the lateral walls (11, 12) are folded with respect to the base wall (10) so as to bring the container (100) into the opened-out configuration (V).

7. The container of claim 1 further comprising:

a wing (4) in a single body with the base wall (10) at a second transversal edge (102) thereof, opposite the first transversal edge (101), and which is foldable with respect to the base wall (10) in such a way as to be arrangeable indifferently both on the same plane as the base wall (10), when the container (100) is in the flattened configuration (I), and in an angled configuration and vertically with respect to the base wall (10), when the container (100) is brought into the opened-out configuration (V).

8. The container of claim 7, wherein the base wall (10) exhibits dimensions such that, with the container (100) in the opened-out configuration (V), between the wing (4) folded at an angle with respect to the base wall (10) and the last tab of the tabs (L1, L2, L3, L4, L5) a space (D1) is present having dimensions that at least correspond to the transversal dimensions of a bottles (8) and such as to define there-between a housing (A) for receiving the bottle (8) in a horizontal configuration.

9. A cardboard blank, foldable for obtaining a cardboard container for receiving bottles in a horizontal configuration according to claim 1, obtained starting from a single cut sheet of cardboard, the blank (F) comprising a main section (F1) and an auxiliary section (F2), flanked to one another and in a single body at a relative common transversal side, the main section (F1) exhibiting a central section (F10), a first lateral section (F11) and a second lateral section (F12), situated at two opposite longitudinal sides thereof, and the auxiliary section (F2) having a series of cut and weakened lines (U) which are realized in such a way and with an extension such that the auxiliary section (F2) exhibits a first auxiliary lateral portion (F15) and a second lateral auxiliary portion (F16) and, between the first lateral auxiliary portion (F15) and the second lateral auxiliary portion (F16) in a single body therewith, at least a pair of tabs (FL1, FL2) with each tab (FL1, FL2) exhibiting a central portion (F30), a first lateral portion (F31), connected in a single body with the first lateral auxiliary portion (F15) and a second lateral portion (F32), connected in a single body with the second auxiliary lateral portion (F16), a first fold line (T1) located between the central section (F10) and the first lateral section (F11) of the main section (F1), so as to enable folding the first lateral section (F11) with respect to the central section (F10) in such a way that the first lateral section (F11) is arranged in an angled position with respect to the central section (F10), a second fold line (T2) between the central section (F10) and the second lateral section (F12) of the main section (F1), so as to enable folding the second lateral section (F12) with respect to the central section (F10) such that the second lateral section (F12) can be arranged in an angled position with respect to the central section (F10), a third fold line (T3), at a part of the common transversal side, between the central section (F10) of the main section (F1) and the central portion (F30) of a first tab (FL1), a fourth fold line (T4), at a second part of the common transversal side, between the first lateral section (F11) of the main section (F1) and the first lateral auxiliary portion (F15) of the auxiliary section (F2) and a fifth fold line (T5) at a third part of the common transversal side, between the second lateral section (F12) of the main section (F1) and the second auxiliary lateral portion (F16) of the auxiliary section (F2), the third (T3), fourth (T4) and fifth (T5) fold lines being such that the auxiliary section (F2) is foldable above the main section (F1) such that the first auxiliary lateral portion (F15) of the auxiliary section (F2) is arranged above and is fixable to the first lateral section (F11) of the main section (F1), the second auxiliary lateral portion (F16) of the auxiliary section (F2) is arranged above and is fixable to the second lateral section (F12) of the main section (F1) and such that the central portion (F30) of the second tab (FL2) of the pair of tabs (FL1, FL2) is fixable to a part of the central section (F10) such that the central portion (F30) is foldable with respect to the central section (F10) in order to be arranged indifferently both above and with an angled configuration with respect thereto, the third fold line (T3) also being such that the central portion (F30) of the first tab (FL1), once the auxiliary section (F2) has been folded above the main section (F1), is foldable with respect to the central section (F10) of the main section (F1) so as to be arrangeable indifferently both above and with an angled configuration with respect thereto, and, for each of the tabs (FL1, FL2) of the pair of tabs (FL1, FL2), fold lines (T6) between the central portion (F30) and the first lateral portion (F31), fold lines (17) between the central portion (F30) and the second lateral portion (F32), fold lines (T8) between the first lateral portion (F31) and the first auxiliary lateral portion (F15) and fold lines (T9) between the second lateral portion (F32) and the second auxiliary lateral portion (F16), the fold lines (T6, 17, T8,T9) being realized and arranged so that the first lateral portion (F31) of each tab (FL1, FL2) is foldable with respect both to the relative central portion (F30) and with respect to the first auxiliary lateral portion (F15), and the second lateral portion (F32) of each tab (FL1, FL2) is foldable with respect both to the relative central portion (F30) and with respect to the second auxiliary lateral portion (F16), so as to be arrangeable indifferently both on a same common plane of the central portion (F30) and in an angled configuration with respect thereto, when the central portion (F30) is folded with an angled configuration with respect to the central section (F10) of the main section (F1).

10. The blank of claim 9, wherein the second tab (FL2) of the pair of tabs (FL1, FL2) exhibits such a shape as to exhibit an appendage (F33) by which appendage (F33) the second tab (FL2) is fixed to the central section (F10) of the main section (F1) when the auxiliary section (F2) is folded above the main section (F1), a fold line (T10) located between the central portion (F30) and the appendage (F33) of the second tab (FL2) so as to enable the central portion (F30), once the appendage (F33) has been fixed to the central section (F10) of the main section (F1), to be foldable with respect to the appendage (F33) so as to be arrangeable with an angled configuration with respect thereto and thus with respect to the central section (F10).

11. The blank of claim 10, wherein the main section (F1) and the auxiliary section (F2) exhibit dimensions such that the auxiliary section (F2) comprises further other cut and weakened lines (U) that have been made in such a way that, and with such an extension, that the auxiliary section (F2) also exhibits further other tabs (FL3, FL4, FL5) having a shape and structure that are identical to the shape and structure of the second tab (FL2), each tab (FL3, FL4, FL5) exhibiting a central portion (F30), a first lateral portion (F31) connected in a single body with the first auxiliary lateral portion (F15) and a second lateral portion (F32), connected in a single body with the second auxiliary lateral portion (F16), and comprising further other fold lines (T6, T7, T8, T9) such as to enable the first lateral portion (F31) of each tab (FL3, FL4, FL5) to be foldable with respect both to the relative central portion (F30) and with respect to the first auxiliary lateral portion (F15), and the second lateral portion (F32) of each tab (FL3, FL4, FL5) to be foldable with respect both to the relative central portion (F30) and with respect to the second auxiliary lateral portion (F16), such as to be arrangeable indifferently both on a same common plane of the central portion (F30) and in an angled configuration with respect thereto, when the central portion (F30) is folded with an angled configuration with respect to the central portion (F10) of the main section (F1).

12. The blank of claim 9, wherein the cutting and weakened lines (U) are realized in the auxiliary section (F2) such that the central portions (F30) of the tabs (FL1, FL2, FL3, FL4, FL5) are reciprocally positioned with respect to one another so that once the auxiliary section (F2) has been folded above the main section (F1) and the central portions (F30) of the tabs (FL1, FL2, FL3, FL4.FL5) have been folded at an angle with respect to the central section (F10) of the main section (F1), the central portions (F30) are distanced from one another so as to define there-between a housing having suitable dimensions for receiving a bottle in a horizontal configuration.

13. The blank of claim 12, wherein the central section (F10) of the main section (F1) comprises a series of through-holes (F9) which are positioned below the central portions (F30) of the tabs (FL1, FL2, FL3, FL4, FL5) when the auxiliary section (F2) is folded above the main section (F1).

14. The blank of claim 9, wherein the central section (F10) of the main section (F1) exhibits a wing (F4), at the transversal side thereof opposite the transversal side wherein the wing is in a single body with the auxiliary section (F2), and a fold line (T11) between the wing (F4) and the central section (F10) so as to enable the wing (F4) to be foldable with respect to the central section (F10) so as to be arrangeable with an angled configuration with respect thereto.

* * * * *